United States Patent [19]

Rossi et al.

[11] 4,375,973

[45] Mar. 8, 1983

[54] ADDITIVE COMBINATIONS AND FUELS CONTAINING THEM

[75] Inventors: Albert Rossi, Warren; David H. Rehrer, Westfield; Alexis A. Oswald, Mountainside, all of N.J.; Kenneth Lewtas, Wantage; Robert D. Tack, Abingdon, both of United Kingdom

[73] Assignee: Exxon Research & Engineering Co., Florham Park, N.J.

[21] Appl. No.: 208,721

[22] Filed: Nov. 20, 1980

[30] Foreign Application Priority Data

Nov. 23, 1979 [GB] United Kingdom ..... 7940510

[51] Int. Cl.[3] ..... C10L 1/16; C10L 1/18

[52] U.S. Cl. ..... 44/62; 44/70; 44/71; 44/72; 252/51.5 A

[58] Field of Search ..... 44/62, 70, 71, 72; 252/51.5 A

[56] References Cited

U.S. PATENT DOCUMENTS

| | | | |
|---|---|---|---|
| 3,374,073 | 3/1968 | Gergel | 44/62 |
| 3,444,082 | 5/1969 | Kautsky | 252/51.5 |
| 3,499,741 | 3/1970 | Sweeney | 44/62 |
| 3,507,636 | 4/1970 | Sweeney | 44/62 |
| 3,524,732 | 8/1970 | Sweeney et al. | 44/62 |
| 3,608,231 | 9/1971 | Sweeney | 44/62 |
| 3,658,493 | 4/1972 | Hollyday, Jr. | 44/62 |
| 3,661,541 | 5/1972 | Hollyday, Jr. | 44/62 |
| 3,681,302 | 8/1972 | Sweeney | 260/80.78 |
| 3,762,888 | 10/1973 | Kober et al. | 44/62 |
| 3,846,093 | 11/1974 | Feldman | 44/62 |
| 3,946,093 | 3/1976 | Koto et al. | 260/973 |
| 3,955,940 | 5/1976 | Hollyday, Jr. | 44/62 |
| 3,961,916 | 6/1976 | Ilnyckyj et al. | 44/62 |
| 3,982,909 | 9/1976 | Hollyday, Jr. | 44/66 |
| 4,140,492 | 2/1979 | Feldman et al. | 44/62 |
| 4,147,520 | 4/1979 | Ilnyckyj | 44/62 |
| 4,210,424 | 7/1980 | Feldman et al. | 44/62 |
| 4,211,534 | 7/1980 | Feldman | 44/62 |
| 4,261,703 | 4/1981 | Tack et al. | 44/62 |

FOREIGN PATENT DOCUMENTS

| | | |
|---|---|---|
| 848777 | 9/1960 | United Kingdom . |
| 900202 | 7/1962 | United Kingdom . |
| 993744 | 6/1965 | United Kingdom . |
| 1068000 | 5/1967 | United Kingdom . |
| 1263152 | 2/1972 | United Kingdom . |
| 1374051 | 11/1974 | United Kingdom . |

*Primary Examiner*—Jacqueline V. Howard
*Attorney, Agent, or Firm*—Frank T. Johmann

[57] ABSTRACT

An additive combination for improving the cold flow properties of distillate fuels comprises a combination of:

(A) a distillate flow improver which is an ethylene containing polymer, preferably a copolymer of ethylene with unsaturated esters, e.g. vinyl acetate;

(B) a hydrocarbon polymer of $C_2$ to $C_{30}$ olefin of number average molecular weight of $10^3$ to $10^6$ or derivatized version thereof, for example copolymers of ethylene and propylene, or polyisobutylene, which are used as lubricating oil V.I. improvers; and (C) a polar oil soluble compound which includes amides, salts, carboxylates, sulfonates, sulfates, phosphates, phenates and borates, having hydrocarbon solubilizing groups, for example salts and amides of polycarboxylic acid such as phthalic anhydride reacted with hydrogenated secondary tallow amine.

12 Claims, No Drawings

ADDITIVE COMBINATIONS AND FUELS CONTAINING THEM

Additive systems for treating distillate fuel oil to improve the flow of wax cloudy fuels through pipelines and filters in cold weather are known, as shown by the following patents.

United Kingdom Pat. Nos. 900,202 and 1,263,152 relate to the use of low molecular weight copolymers of ethylene and unsaturated esters especially vinyl acetate, whilst United Kingdom Pat. No. 1,374,051 relates to the use of an additive system which both raises the temperature at which wax crystallisation starts and limits the size of the wax crystals. The use of low molecular weight copolymers of ethylene and other olefins as pour point depressants for distillate fuels is described in U.K. Pat. Nos. 848,777, 993,744 and 1,068,000 and U.S. Pat. No. 3,679,380. Various other special types of polymer are suggested as additives for distillate fuels in U.S. Pat. Nos. 3,374,073, 3,499,741, 3,507,636, 3,524,732, 3,608,231 and 3,681,302.

It has also been proposed that combinations of additives may be used in distillate fuels to further improve their flow and pour point properties. For example, U.S. Pat. No. 3,661,541 is concerned with the use of combinations of the ethylene/unsaturated ester copolymer types of additive and low molecular weight ethylene propylene copolymers of U.K. Pat. No. 993,744 in which copolymers contain small amounts of propylene.

U.S. Pat. No. 3,658,493 teaches various nitrogen salts and amides of acids such as mono and dicarboxylic acids, phenols, sulfonic acids in combination with ethylene homo or copolymeric pour depressants for middle distillate oils.

U.S. Pat. No. 3,982,909 teaches nitrogen compounds such as amides, diamides, and ammonium salts of monoamides or monoesters of dicarboxylic acids, alone or in combination with petroleum derived microcrystalline wax and/or a pour point depressant, particularly an ethylene backbone polymeric pour point depressant, are wax crystal modifiers and cold flow improvers for middle distillate fuel oils, particularly diesel fuel.

U.S. Pat. Nos. 3,444,082 and 3,946,093 teach use of various amides and amine salts of alkenyl succinic anhydride in combination with ethylene copolymer pour point depressants, for distillate fuels.

The additives described above have been used to lower the pour point of the distillate fuel generally by preventing oil gelation by wax crystals and/or to improve the ability of the wax containing oil to flow through filters by reducing the sizes of the wax crystals. Whilst it is important to achieve these effects, it is desirable to further reduce the crystal size and there is a further problem in oils whose pour point and flow characteristics have been improved in that during storage of the oil in cold weather, wax crystals that form tend to settle and agglomerate which poses distribution problems.

Due to the large volume of the oil in storage tanks, the bulk oil temperature drops slowly, even though the ambient temperature may be considerably below the cloud point of the oil (the temperature at which the wax begins to crystallize out and becomes visible, i.e., the oil becomes cloudy). If the winter is particularly cold and prolonged so that oil is stored for a long time during very cold weather, the temperature of oil stored even in large commercial tanks may eventually drop below its cloud point. These conditions may then result in wax agglomeration which is further enhanced as the higher density wax concentrates in the lower section of the tank.

We have found that these problems may be significantly reduced by using certain additive combinations. We have also found that under certain conditions the use of these additive combinations can give better control of crystal size than a similar concentration of the previous additives. The present invention therefore, provides additive combinations comprising materials of the classes (A), (B) and (C) described below:

(A) a distillate flow improving composition, (B) a high molecular weight hydrocarbon polymer of number average molecular weight greater than $10^3$, preferably greater than $10^4$, or a derivatised version thereof, and (C) a polar oil soluble compound different from (A) and (B) and of formula RX as hereinafter described.

We have found these combinations to be particularly useful in distillate fuel oils boiling in the range of 120° C. to 500° C., especially 160° C. to 400° C. for controlling the growth and agglomeration of separating waxes. The present invention therefore, also provides such distillate fuel oils containing such additive combinations.

The total additive content in the fuel is 0.001 to 1.0 wt. %, preferably from 0.001 to 0.5 wt. %, e.g. 0.005 to 0.2 wt % more preferably 0.01 to 0.2 wt %, most preferably 0.005 to 0.05 wt % e.g. 0.02 to 0.1 wt %. This may consist of a combination of (A), (B) and (C), each being present in an amount from 0.1 to 10 parts by weight relative to each other. We prefer that it contain one part by weight of distillate flow improver composition (A), 0.1 to 10, preferably 0.2 to 2 parts by weight of the hydrocarbon polymer (B), and 0.1 to 10, preferably 0.2 to 1 parts of weight by the polar oil soluble compound (C).

For ease of handling the additives will generally be supplied as concentrates containing 10 to 90 wt. %, preferably 30 to 80 wt. % of a hydrocarbon diluent with the remainder being additive. The present invention is also concerned with such concentrates.

The distillate flow improver (A) used in the additive combinations of the present invention is a wax crystal growth arrestor and may also contain a nucleator for the wax crystals as defined in U.K. Pat. No. 1,374,051. Such growth arrestors and nucleators are preferably ethylene polymers of the type known in the art as wax crystal modifiers, e.g. pour depressants and cold flow improvers for distillate fuel oils. These polymers have a polymethylene backbone which is divided into segments by hydrocarbon or oxy-hydrocarbon side chains, by alicyclic or heterocyclic structures, or by chlorine atoms. They may be homopolymers of ethylene as prepared by free radical polymerization which may result in some branching. More usually, they will comprise copolymers of about 3 to 40, preferably 4 to 20, molar proportions of ethylene per molar proportion of a second ethylenically unsaturated monomer which is defined below, and which can be a single monomer or a mixture of monomers in any proportion. The polymers will generally have a number average molecular weight in the range of 500 to 50,000, e.g. 500 to 10,000, preferably 1,000 to 6,000, as measured by Vapor Pressure Osmometry (VPO).

The unsaturated monomers, copolymerizable with ethylene, include unsaturated mono and diesters of the general formula:

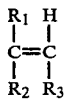

wherein $R_1$ is hydrogen or methyl; $R_2$ is a —$OOCR_4$ group wherein $R_4$ is hydrogen or a $C_1$ to $C_{28}$, more usually $C_1$ to $C_{17}$, and preferably a $C_1$ to $C_8$, straight or branched chain alkyl group; or $R_2$ is a —$COOR_4$ group wherein $R_4$ is as previously described but is not hydrogen and $R_3$ is hydrogen or —$COOR_4$ as previously defined. The monomer, when $R_1$ and $R_3$ are hydrogen and $R_2$ is —$OOCR_4$, includes vinyl alcohol esters of $C_1$ to $C_{29}$, more usually $C_1$ to $C_{18}$, monocarboxylic acid, and preferably $C_2$ to $C_5$ monocarboxylic acid. Examples of such esters include vinyl acetate, vinyl isobutyrate, vinyl laurate, vinyl myristate and vinyl palmitate, vinyl acetate being the preferred ester. When $H_2$ is —$COOR_4$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate, di-lauryl fumarate and ethyl methyl fumarate. In the case of monoesters of dicarboxylic acids the remaining carboxylic group is reacted with an amine yielding, either an amine salt or amide of a hemiester.

Another class of monomers that can be copolymerized with ethylene include $C_3$ to $C_{30}$, preferably $C_3$ to $C_{18}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained by chlorinating polyethylene, e.g. up to a chlorine content of about 35 wt. %.

Also included among the distillate flow improvers are the hydrogenated polybutadienes flow improvers formed mainly by 1,4-addition with some 1,2-addition, such as those of U.S. Pat. No. 3,600,311.

The preferred ethylene copolymers are ethylene-vinyl ester copolymers, especially vinyl acetate copolymers. These may be prepared at high pressure in the presence or absence of a solvent. When copolymerisation is carried out in solution, solvent and 5–50 wt. % of the total amount of monomer charged, other than ethylene, are charged into a stainless steel pressure vessel which is equipped with a stirrer and a heat exchanger. The temperature of the pressure vessel is then brought to the desired reaction temperature, e.g. 70° to 200° C. while simultaneously pressurising the autoclave with ethylene to the desired pressure, e.g. 700 to 25,000 psig, usually 900 to 7,000 psig. The initiator, usually diluted (or dissolved if solid) with polymerization solvent is injected during the polymerisation, and additional amounts of the monomer charge other than ethylene, e.g. the vinyl ester, are pumped into the vessel continuously, or at least periodically, during the reaction time. Also during this reaction time, as ethylene is consumed in the polymerization reaction, additional ethylene is supplied through a pressure controlling regulator so as to maintain the desired reaction pressure fairly constant at all times. The temperature of copolymerization is held substantially constant by means of the heat exchanger. Following the completion of the reaction, usually a total reaction time of ¼ to 10 hours suffices, the liquid phase is discharged from the reactor. Solvent and other volatile constituents of the reaction mixture are stripped off, leaving the copolymer as residue. To facilitate handling and blending, the polymer is generally dissolved in a mineral oil, preferably an aromatic solvent, such as heavy aromatic naphtha, to form a concentrate usually containing 10 to 60 wt. % of copolymer.

The initiator is chosen from a class of compounds which at elevated temperatures undergo a breakdown yielding radicals, such as peroxide or azo type initiators, including the acyl peroxides of $C_2$ to $C_{18}$, branched or unbranched, carboxylic acids, as well as other common initiators. Specific examples of such initiators include dibenzoyl peroxide, di-tertiary butyl peroxide, t-butyl perbenzoate, t-butyl peroctoate, t-butyl hydroperoxide, alpha, alpha', azo-diisobutyronitrile, dilauroyl peroxide, etc. The choice of the peroxide is governed primarily by the polymerization conditions to be used, the desired polymer structure and the efficiency of the initiator. t-Butyl peroctanoate, di-lauroyl peroxide and di-t-butyl peroxide are preferred initiators.

The high molecular weight, oil soluble, hydrocarbon "B", preferably an olefin copolymer, should have a number average molecular weight of from $10^3$ to $10^6$, preferably $10^4$ to $10^6$, preferably 20,000 to 250,000, more preferably 20,000 to 150,000, most preferably 50,000 to 150,000 or 10,000 to 50,000 as determined by gel permeation chromatography or more preferably by membrane osmometry. Examples of suitable hydrocarbon polymer include homopolymers and copolymers of two or more monomers of $C_2$ to $C_{30}$, e.g. $C_2$ to $C_8$ olefins, including both alpha olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene, and polymers of other olefins such as propylene and butene and the preferred polyisobutylenes. Also homopolymers and copolymers of $C_6$ and higher alpha olefins can be preferably employed.

Such hydrocarbon polymers also include olefin polymers such as atactic polypropylene, hydrogenated polymers and copolymers and terpolymers of styrene, e.g. with isoprene and/or butadiene. The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489 and 4,149,984. The oil soluble polymer may also be a Viscosity Index improver.

The preferred hydrocarbon polymers are ethylene copolymers containing from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methylheptene-1, etc., and mixtures thereof.

Terpolymers, tetrapolymers, etc., of ethylene, said $C_{3-28}$ alpha-olefin, and a non-conjugated diolefin or mixtures of such diolefins may also be used. The amount of the non-conjugated diolefin ranges from about 0.5 to 20 mole percent, preferably about 1 to about 7 mole percent, based on the total amount of ethylene and alpha-olefin present.

Representative examples of non-conjugated dienes that may be used as the third monomer in the terpolymer include:

a. Straight chain acyclic dienes such as: 1,4-hexadiene; 1,5-heptadiene, 1,6-octadiene.

b. Branched chain acyclic dienes such as: 5-methyl-1,4-hexadiene; 3,7-dimethyl-1,6-octadiene; 3,7-dimethyl-1,7-octadiene; and the mixed isomers of dihydromyrcene and dihydro-cymene.

c. Single ring alicyclic dienes such as: 1,4-cyclohexadiene; 1,5-cyclooctadiene; 1,5-cyclo-dodecadiene, 4-vinylcyclohexene; 1-allyl-4-isopropylidene cyclohexane; 3-allyl-cyclopentene; 4-allyl cyclohexene and 1-isopropenyl-4-(4-butenyl) cyclohexane.

d. Multi-single ring alicyclic dienes such as: 4,4'-dicyclopentenyl and 4,4'-dicyclohexenyl dienes.

e. Multi-ring alicyclic fused and bridged ring dienes such as: tetrahydroindene; methyl tetrahydroindene; dicyclopentadiene; bicyclo (2.2.1) hepta 2,5-diene; alkyl, alkenyl, alkylidene, cycloalkenyl and cycloalkylidene norbornenes such as: ethyl norbornene; 5-methylene-6-methyl-2-norbornene; 5-methylene-6, 6-dimethyl-2-norbornene; 5-propenyl-2-norbornene; 5-(3-cyclopentenyl)-2-norbornene and 5-cyclohexylidene-2-norbornene; norbornadiene; etc.

Of the above, preferred representative diolefins include cyclopentadiene, 2-methylene-5-norbornene, non-conjugated hexadiene, or any other alicyclic or aliphatic non-conjugated diolefin, having from 6 to 15 carbon per molecule, such as 2-methyl or ethyl norbornadiene, 2,4-dimethyl-2-octadiene, 3-(2-methyl-1-propene) cyclopentene, ethylidene norbornene, etc.

Terpolymers, tetrapolymers, etc. useful in the present invention preferably contain at least 30 mol percent, preferably not more than 85 mol percent of ethylene; between about 15 and about 70 mol percent of a higher alpha-olefin or mixture thereof, preferably propylene; and between 1 and 20 mol percent, preferably 1 to 15 mol percent, of a non-conjugated diene or mixture thereof. Especially preferred are polymers of about 40 to 70 mol percent ethylene, 20 to 58 mol percent higher monoolefin and 2 to 10 mol percent diene. On a weight basis, usually the diene will be at least 2 or 3 weight percent of the total terpolymer.

Polyisobutylenes are readily obtained in a known manner as by following the procedure of U.S. Pat. No. 2,084,501 wherein the isoolefin, e.g. isobutylene, is polymerized in the presence of a suitable Friedel-Crafts catalyst, e.g. boron fluoride, aluminum chloride, etc., at temperatures substantially below 0° C. such as at −40° C. Such polyisobutylenes can also be polymerized with a higher straight chained alpha-olefin of 6 to 20 carbon atoms as taught in U.S. Pat. No. 2,534,095 where said copolymer contains from about 75 to about 99% by volume of isobutylene and about 1 to about 25% by volume of a higher normal alpha-olefin of 6 to 20 carbon atoms.

These ethylene copolymers, this term including terpolymers, tetrapolymers, etc. may be prepared using the well known Ziegler-Natta catalyst compositions as described in U.K. Pat. No. 1,397,994.

Such polymerization may be effected to produce the ethylene copolymers by passing 0.1 to 15, for example, 5 parts of ethylene; 0.05 to 10, for example, 2.5 parts of said higher alpha-olefin, typically propylene; and from 10 to 10,000 parts of hydrogen per million parts of ethylene; into 100 parts of an inert liquid solvent containing (a) from about 0.0017 to 0.017, for example, 0.0086 parts of a transition metal principal catalyst, for example, $VOCl_3$; and (b) from about 0.0084 to 0.084, for example, 0.042 parts of cocatalyst, e.g. $(C_2H_5)_3Al_2Cl_3$; at a temperature of about 25° C. and a pressure of 60 psig for a period of time sufficient to effect optimum conversion, for example, 15 minutes to one-half hour; all parts being parts by weight.

Other suitable hydrocarbon polymers may be made from styrene, and substituted styrenes, such as alkylated styrene, or halogenated styrene. The alkyl group in the alkylated styrene, which may be a substituent on the aromatic ring or on an alpha carbon atom, may contain from 1 to about 20 carbons, preferably 1–6 carbon atoms. These styrene type monomers may be copolymerized with suitable conjugated diene monomers including butadiene and alkyl-substituted butadiene, etc., having from 1 to about 6 carbons in the alkyl substituent. Thus, in addition to butadiene, isoprene, piperylene and 2,3-dimethylbutadiene are useful as the diene monomer. Two or more different styrene type monomers as well as two or more different conjugated diene monomers may be polymerized to form the interpolymers. Still other useful polymers are derived without styrene and only from aliphatic conjugated dienes, usually having from 4 to 6 carbon atoms most usefully, butadiene. Examples are homopolymers of 1,3-butadiene, isoprene, 1,3-pentadiene, 1,3-dimethylbutadiene, copolymers formed with at least two of these conjugated dienes and copolymers of the latter with styrene, these homopolymers and copolymers having been hydrogenated. These aforesaid polymers with considerable unsaturation are preferably fully hydrogenated to remove substantially all of the olefinic usaturation, although, in some situations, partial hydrogenation of the aromatic-type unsaturation is effected. These interpolymers are prepared by conventional polymerization techniques involving the formation of interpolymers having a controlled type of steric arrangement of the polymerized monomers, i.e. random, block, tapered, etc. Hydrogenation of the interpolymer is effected using conventional hydrogenation processes.

A separate subclass of class B, are the hydrocarbon polymers described above which have been derivatised to contain polar groups, e.g. by grafting onto them maleic anhydride followed by amination, or by phosphoro-sulphurisation, or which may be sulfonated, phosphonated, oxidized, halogenated, e.g. chlorinated or brominated, epoxidized, chlorosulfonated, hydroxylated or grafted with other monomers such as vinyl pyridine, etc.

The polar compound (C) is different from (A) and (B) and is generally monomeric and may be ionic or non-ionic. The compound is believed to further inhibit agglomeration of wax crystals by being adsorbed onto crystal faces through their hydrocarbon portions.

Suitable polar compounds of class "C" may be either non-ionic or ionic; if ionic, they may be combinations of mono- or poly-functional anions and cations.

Mono-functional, oil soluble, ionic or non-ionic compounds, may be represented by the formula $R_5X$ and salts may be represented by the formula $R_5X\ ZR_6$ in which $R_5$ is an oil solubilizing group and X is the polar group. $R_5$ may be one or more substituted or unsubstituted, saturated or unsaturated hydrocarbon groups which may be aliphatic, cycloaliphatic, or aromatic, preferably alkyl, alkaryl or alkenyl, most preferably $R_5$ is saturated. $R_5$ should preferably contain a total of from 8 to 150 carbon atoms. Where the compound RX is non-ionic, we prefer that $R_5$ contains from 14 to 60 carbon atoms, more preferably 16 to 40 carbon atoms. Where $R_5X$ is an anion, we prefer that $R_5$ contains from 8 to 150 carbon atoms, more preferably 12 to 50, most preferably 14 to 40 carbon atoms. We particularly prefer that alkyl groups contain from 1 to 35, most preferably from 12 to 30, carbon atoms. It is preferred that when $R_5$ is composed of alkyl groups that they be straight chain. Alternatively $R_5$ may be an alkyloxylated chain.

Examples of suitable polar groups X include the carboxylate $COO^-$, the sulphonate $SO_3^-$ group, the sulphate $OSO_3^-$ group, the phosphate $O_2PO_2^-$ group, the phenate $PhO^-$ group and the borate $O_2BO^-$ group. Thus our preferred anions include $R_7COO^-$, $R_7SO_3^-$, $R_7OSO_3^-$; $(R_7O)_2PO_2^-$; $R_7PhO^-$ and $(R_7O)_2BO^-$ with $R_7$ being the oil solubilizing hydrocarbon group, the total carbon atoms content of $R_7$ being within the limits described above for $R_5$.

Where the anion is a sulphonate, we prefer to use an alkaryl sulphonate which may be any of the well known neutral or basic sulphonates.

Where the anion is phenate, we prefer it be derived from alkyl phenol, or bridged phenols, including those of the general formula:

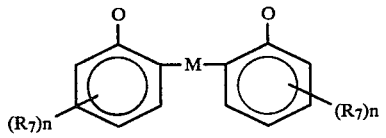

where M is a linking group of one or more, e.g. 1 to 4, carbon or sulphur atoms, and $R_7$ is as defined above. Here again, the phenate used may be any of the well known neutral or basic compounds.

When the anion is borate, sulphate or phosphate, $R_7$ may alternatively be alkoxylated chains. Examples of such compounds in the case of sulphates include the $(R_8—(OCH_2CH_2)_n—O)$ group and in the case of phosphates and borates the $(R_8—(OCH_2CH_2)_n—O)_2$ group, wherein the total carbon content of the $R_8$'s is as defined for $R_5$ above.

The cation for these salts is preferably a mono-, di-, tri- or tetra-alkyl ammonium or phosphonium ion of formula:

$$R_6ZH_3^+;\ (R_6)_2ZH_2^+;\ (R_6)_3ZH^+;\ (R_6)_4Z^+$$

where $R_6$ is hydrocarbyl, preferably alkyl group. When the cation contains more than one such group they may be the same or different and Z is nitrogen or phosphorus. $R_6$ preferably contains 4 to 30, more preferably 14 to 20 carbon atoms, it is also preferred that $R_6$ consist of straight chain alkyl groups.

Examples of suitable alkyl groups include methyl, ethyl, propyl, n-octyl, n-dodecyl, n-tridecyl, $C_{13}$ Oxo, coco, hydrogenated tallow, behenyl, lauryl.

The group $R_6$ may be substituted by, for example, hydroxy or amino groups (as for example in the polyamine). As an alternative embodiment the hydrocarbyl group of the cation can provide the oil-solubility, as for example in the salts of fatty amines such as hydrogenated tallow amine.

Derivatives of alkyl substituted dicarboxylic acids or their anhydrides may also be used as the polar compound. For example, succinic acid derivatives of the general formula:

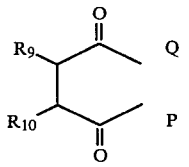

where at least one of $R_9$ or $R_{10}$ is a long chain (e.g. 10 to 120 preferably 12 to 100) carbon atoms alkyl or alkenyl group, e.g. polyisobutylene or polypropylene. The other of $R_9$ or $R_{10}$ may be similar or be hydrogen. P and Q may be the same or different, they may be hydroxy groups, alkoxy or may together form an anhydride ring.

As a less preferred alternative the cation may be metallic and if so the metal is preferably an alkali metal such as sodium or potassium or an alkaline earth metal such as barium, calcium or magnesium.

Whilst the ionic type compounds described above are our preferred polar oil soluble compounds we have found that polar, non-ionic compounds are also effective. For example primary amines of formula $R_{11}—NH_2$, secondary amines $(R_{11})_2NH$ and primary alcohols $R_{11}—OH$ may be used providing they are oil soluble and for this reason $R_{11}$ preferably contains at least 8 carbon atoms and preferably has the carbon content specified above for $R_5$ in the case of non-ionic compounds.

Nitrogen compounds are particularly effective polar compounds for keeping the wax crystals separate from each other, i.e. by inhibiting agglomeration of wax crystals and are our preferred component (C) of the additive mixtures. Examples of suitable compounds include oil soluble ammonium salts, amine salts and/or imides, which will be generally formed by reaction of at least one molar proportion of an amine with one molar portion of a hydrocarbyl acid having 1 to 4 carboxylic acid groups, or their anhydrides.

In the case of polycarboxylic acids or anhydrides thereof, all acid groups may be converted to amine salts or amides, or some of the acid groups may be converted to esters by reaction with hydrocarbyl alcohols or left unreacted. Examples of suitable amides are those of succinic acid as described in U.K. Pat. No. 1,140,771.

The hydrocarbyl groups of the nitrogen compounds described above may be straight or branched chain, saturated or unsaturated, aliphatic, cycloaliphatic, aryl or alkaryl and will be long chain, e.g. $C_{12}$ to $C_{40}$, preferably $C_{14}$ to $C_{24}$. However, some short chains, e.g. $C_1$ to $C_{11}$ may be included providing the total number of carbons in the compound is sufficient for solubility in the distillate fuel oil. Generally a total of 30 to 300, e.g. 36 to 160 carbon atoms is sufficient for oil solubility although the number of carbon atoms needed will vary with the degree of polarity of the compound. The compound will preferably also contain at least one straight chain alkyl segment containing 8 to 40, preferably 12 to 30 carbon atoms. This straight chain alkyl segment may be in one or in several of the amines or ammonium ions, or in the acids, or in the alcohol (if an ester group is also present). At least one ammonium salt, or amine salt, or amide linkage is required to be present in the molecule.

The hydrocarbyl groups may contain other groups, or atoms, such as hydroxy groups, carbonyl groups, ester groups, or oxygen, or sulfur, or chlorine atoms.

The amines which may be reacted with the carboxylic acids include primary, secondary, tertiary or quaternary, but preferably are secondary. If amides are to be made, the primary or secondary amines will be used.

Examples of primary amines include n-dodecyl amine, n-tridecyl amine, $C_{13}$ Oxo amine, coco amine, tallow amine, and behenyl amine. Examples of secondary amines include methyl-lauryl amine, dodecyl-octyl amine, coco-methyl amine, tallow-methylamine, methyl-n-octyl amine, methyl-n-dodecyl amine, methyl-behenyl amine and di hydrogenated tallow amine. Examples of tertiary amines include cocodiethyl amine, cyclohexyl-diethyl amine, coco-dimethyl amine and methyl certyl stearyl amine, etc. methyl-ethyl-coco amine, methyl-cetyl-stearyl amine, etc. Examples of quaternary ammonium cations or salts include dimethyldicetyl ammonium and dimethyl distearyl ammonium chloride.

Amine mixtures may also be used and many amines derived from natural materials are mixtures. Thus, coco amines derived from coconut oil are mixtures of primary amines with straight chain alkyl groups ranging from $C_8$ to $C_{18}$. Another example is hydrogenated tallow amine, derived from tallow acids, which amine contains a mixture of $C_{14}$ to $C_{18}$ straight chain alkyl groups. Hydrogenated tallow amine is particularly preferred.

Examples of the carboxylic acids or anhydrides, include formic, acetic, hexanoic, lauric, myristic, palmitic, hydroxy stearic, behenic, naphthenic, salicyclic, linoleic, dilinoleic, trilinoleic, maleic, maleic anhydride, fumaric, succinic, succinic anhydride, the alkenyl succinic anhydrides previously described, adipic, glutaric, sebaric, lactic, malic, malonic, citraconic, phthalic acids (ortho, meta or para), e.g. terephthalic, phthalic anhydride, citric, gluconic, tartaric, 9,10-di-hydroxystearic amd cyclo-hexane 1,2 dicarboxylic acid.

Specific examples of alcohols which may also be reacted with the acids include 1-tetradecanol, $C_{13}$ to $C_{18}$ Oxo alcohols made from a mixture of cracked wax olefins, 1-hexadecanol, 1-octadecanol, behenyl, 1,2-dihydroxy octadecane and 1,10-dihydroxydecane.

The amides can be formed in a conventional manner by heating a primary or secondary amine with acid, or acid anhydride. Similarly, the ester is prepared in a conventional manner by heating the alcohol and the polycarboxylic acid to partially esterify the acid or anhydride (so that one or more carboxylic groups remain for the reaction with the amine to form the amide or amine salt). The alkyl ammonium salts are also conventionally prepared by simply mixing the amine (or ammonium hydroxide) with the acid or acid anhydride, or the partial ester of a polycarboxylic acid, or partial amide of a polycarboxylic acid, with stirring, generally with mild heating (e.g. 60°-80° C.). Particularly preferred are nitrogen compounds of the above type that are prepared from dicarboxylic acids. Mixed amine salts/amides are most preferred, and these can be prepared by heating maleic anhydride, alkenyl succinic anhydride or phthalic acid or anhydride with a secondary amine, preferably hydrogenated tallow amine, at a mild temperature e.g. 60° C.

The addition of (C) reduces the size of the wax crystals which can reduce the rate at which wax settles from fuels containing only the distillate flow improvers. We find that the presence of these polar compounds is effective in common fuel storage conditions, even when fuel is stored for an extended period at low temperatures and when its temperature is reduced very slowly (i.e. around 0.3° C./hour).

The distillate fuel oils in which the additive combinations of the present invention are especially useful generally boil within the range of 120° C. to 500° C., e.g. 160° C. to 400° C. The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels and heating oils. The heating oil may be either a straight run distillate or a cracked gas oil or a combination of the two. The low temperature flow problem alleviated by using the additive combinations of the present invention is most usually encountered with diesel fuels and with heating oils.

There has been a tendency recently to increase the final boiling point (FBP) of distillates so as to maximise the yield of fuels. These fuels however, include longer chain paraffins in the fuel and therefore generally have higher cloud points. This in turn aggravates the difficulties encountered in handling these fuels in cold weather and increases the need to include flow improving additives. It has been found that the combination of additives of the present invention is particularly useful in these fuels.

Oil soluble, as used herein, means that the additive, is soluble in the fuel at ambient temperatures, e.g. at least to the extent of 0.1 wt % additive in the fuel oil at 25° C., although at least some of the additive comes out of solution near the cloud point in order to modify the wax crystals that form.

The invention is illustrated but in no way limited by reference to the following Examples.

In these Examples the distillate flow improver Al used was a concentrate in an aromatic diluent of about 50 wt % of a mixture of two ethylene-vinyl acetate copolymers, having different oil solubilities, so that one functioned primarily as a wax growth arrestor and the other as a nucleator, in accord with the teachings of U.K. Pat. No. 1374051. More specifically, the two polymers are in a ratio of about 75 wt % of wax growth arrestor and about 25 wt % of nucleator. The wax growth arrestor consists of ethylene and about 38 wt % vinyl acetate, and has a number average molecular weight of about 1800 (VPO). It is identified in said U.K. Pat. No. 1374051 as Copolymer B of Example 1 and is similarly described in corresponding U.S. Pat. No. 3,961,916 in column 8, lines 25-35. The nucleator consists of ethylene and about 16 wt % vinyl acetate and has a number average molecular weight of about 3000 (VPO). It is identified in said U.K. Pat. No. 1374051 as copolymer H and is similarly described in corresponding U.S. Pat. No. 3,961,916 Table I, columns 7–8. Distillate flow improver A2 was the wax growth arrestor component of A1 used on its own.

The hydrocarbon polymer B1, useful as a lubricating oil viscosity index (V.I.) improver, was a copolymer of ethylene and propylene of number average molecular weight about 35,000–40,000 (by membrane osmometry) containing 44 wt. % ethylene, which is substantially linear and was prepared by Ziegler-Natta catalysts.

The polar compounds used were:

C1 was a half amide/half alkyl ammonium salt obtained by reacting two moles of di-(hydrogenated tallow)-amine with one mole of phthalic anhydride.

C2 was the diamide produced by dehydrating C1.

C3 was a citric triamide formed by dehydrating the reaction product of three moles of dihydrogenated tallow-amine with one mole or citric acid.

The fuels in which the additives were tested are described in the following table:

| Fuel | 1 | 2 | 3 | 4 |
|---|---|---|---|---|
| Cloud Point, °C. (as measured by ASTM D-2500) | −3 | 0 | 0 | −12 |
| Wax Appearance Point, °C. (see ASTM D-3117) | −6 | −2 | −2 | |
| Distillation, °C. (ASTM D-86): | | | | |
| Initial Boiling Point, °C. | 180 | 170 | 178 | 200 |
| 20% Boiling Point | | | 238 | |
| 90% Boiling Point | | | 342 | |
| Final Boiling Point | 365 | 372 | 365 | 346 |
| CFPP, °C. (untreated) | −5 | −1 | −2 | |

The initial response of the oil to the additives was measured by the Cold Filter Plugging Point Test (CFPPT) which is carried out by the procedure described in detail in "Journal of the Institute of Petroleum", Volume 52, Number 510, June 166, pp. 173–185. In brief a 40 ml. sample of the oil to be tested is cooled in a bath which is maintained at about −34° C. Periodically (at each one degree Centrigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml. of oil. After each successful passage the oil is returned immediately to the CFPP tube. The test is repeated with each one degree drop in temperature until the oil fails to fill the pipette within 60 seconds. This temperature is reported as the CFPP temperature.

Another determination of the additives performance is made under conditions of slower, more natural, cooling. The performances of these additives in the described fuels were determined by two types of Filter Screen Analysis (FSA) under different cooling conditions.

FSA 1

100 g samples of fuel are cooled under the specified conditions (below). The resultant samples are shaken to homogenise the wax in fuel suspension. 40 ml of this suspension is poured into a pour point tube and a 20 ml. pipette, carrying a filter screen (ca. 1 cm diameter circle of the meshes described below) on the lower end, is placed into this tube. The waxy cloudy fuel is then sucked into the pipette (under a suction pressure of 20 cm of water), through the filter screen. If the pipette fills in less than 30 seconds the sample is said to pass the filter screen, otherwise it fails.

FSA 2

300 g samples of fuel are cooled under the specified conditions (below). The resultant samples have approximately 20 ml of the surface fuel layer removed by suction to prevent the test being influenced by the abnormally large wax crystals which tend to form on the surface on cooling. The sample, without surface crystals, is then shaken to homogenise the wax in fuel suspension. A pipette bearing a similar filter screen to that described in FSA 1 and which is also connected to a 250 ml measuring cylinder, is placed in the sample and all the fuel is then sucked through the pipette into the measuring cylinder (under a suction pressure of 30 cm of water) through the filter screen. If all the fuel is sucked through in 60 seconds the sample is said to pass the filter screen.

Pipettes with filter screens of 20, 30, 40, 60, 80, 100, 120, 150, 200, 250, 350 mesh number are used to determine the smallest mesh (largest number) the fuel will pass.

The cooling procedures used in testing are summarised below and these letters will be used in the Examples to indicate which cooling procedure had been used before testing:

| Cooling Test | Rate of Cooling (°C./hour) | Start Temp. (°C.) | Finish Temp. (°C.) | Cold Soak (hours) |
|---|---|---|---|---|
| S | 1.0 | 0 | −11.5 | 36 |
| T | 1.0 | 0 | −11.5 | 14 |
| U | 0.3 | 0 | −11.5 | 36 |
| V | 1.0 | 1.5 Cycle* | −8.5 | 9 |
| W | 2.5 | 0 | −11.5 | 60 |
| X | 1.0 | 0 | −11.5 | 10 |
| Y | 0.3 | 0 | −11.5 | 22 |
| Z | 1.0 | 0 Cycle* | −11.5 | 2 |

*Those tests marked cycle were performed by cooling from the start temperature at 1° C./hour down to the finish temperature, holding there for 30 hours, warming up to the start temperature in 2 hours, holding there for 5 hours, then cooling down to the finish temperature again at 1° C./hour.

The following examples describe the performances of fuels containing various additive packages. Although each component may have been used as a solution in an inert diluent, all the numbers in Examples 1 to 5 are the actual concentrations of additives in parts per million of active ingredient.

EXAMPLE 1

The Results Obtained Are As Follows

| Additive (ppm) | | | Filterability Test FSA 1 Fuel 1 | | | | |
|---|---|---|---|---|---|---|---|
| Flow Improver | Hydrocarbon Polymer | Polar Compound | Mesh Passed* | | | | CFPP °C. |
| A2 (100) | — | — | (S) | 30 | (U) | 30 | −6 |
| A1 (300) | — | — | (S) | 80 | (U) | 40 | −19 |

-continued

| Filterability Test FSA 1 Fuel 1 | | | | | | | |
|---|---|---|---|---|---|---|---|
| Additive (ppm) | | | | | | | |
| Flow Improver | Hydrocarbon Polymer | Polar Compound | Mesh Passed* | | | | CFPP °C. |
| — | B1 (100) | — | (S) | 40 | (U) | Fail 20 | −10 |
| A2 (100) | B1 (100) | — | (S) | 60 | (U) | 120 | −16 |
| A1 (100) | B1 (100) | — | (T) | 80 | (U) | 40 | −20 |
| A1 (200) | — | — | (T) | 60 | (U) | 40 | −16 |
| — | B1 (150) | C1 (150) | (T) | 150 | (U) | 80 | −16 |
| — | B1 (100) | C3 (100) | (T) | 350 | (U) | 80 | −17 |
| A2 (100) | B1 (100) | C1 (100) | (S) | 150 | (U) | 120 | −19 |
| A2 (300) | — | — | (S) | 120 | (U) | 60 | −14 |
| A1 (100) | B1 (100) | C1 (100) | (S) | 250 | (U) | 150 | −20 |

*Letters in parenthesis indicate cooling procedure used.

EXAMPLE 2

Filterabilities Obtained On Bottom 10% Of Samples

| Filterability Test FSA 1 Cooling Condition V Fuel 1 | | | |
|---|---|---|---|
| Additive (ppm) | | | |
| Flow Improver | Hydrocarbon Polymer | Polar Compound | Mesh Passed |
| A2 (207) | | | 30 |
| A2 (69) | B1 (75) | C1 (75) | 150 |
| A2 (69) | B1 (75) | C2 (75) | 60 |
| A2 (69) | B1 (75) | C3 (75) | 60 |

EXAMPLE 3

Various hydrocarbon polymers were tested in combination with a flow improver (A2) and a polar compound (C1).

Hydrocarbon Polymer B2 had a number average molecular weight of 60,000 to 65,000 and contained 44 wt % ethylene.

Hydrocarbon Polymer B3 had a number average molecular weight of 17,000 to 20,000 and contained 44 wt % ethylene.

Hydrocarbon Polymer B4 had a number average molecular weight of about 55,000 and contained 67 wt % ethylene.

The molecular weights were by membrane osmometry and the polymers were prepared by Ziegler-Natta Catalysts so as to be substantially linear.

| Filterability Test FSA 1 Fuel 1 | | | | | | |
|---|---|---|---|---|---|---|
| Additive (ppm) | | | Mesh Passed Cooling Conditions | | | |
| Flow Improver | Hydrocarbon Polymer | Polar Compound | W | X | Y | Z |
| A2 (125) | — | — | 60 | 20 | 20 | |
| A2 (250) | — | — | 120 | 40 | 40 | |
| A2 (175) | B2 (75) | — | 350 | 60 | 60 | |
| A2 (175) | B1 (75) | — | 150 | 40 | 40 | |
| A2 (175) | B3 (75) | — | 150 | 40 | 40 | |
| A2 (175) | B4 (75) | — | 120 | 40 | 40 | |
| A2 (100) | B2 (50) | C1 (100) | 350 | 120 | 60 | 350 |
| A2 (100) | B1 (50) | C1 (100) | 350 | 60 | 60 | 200 |
| A2 (100) | B3 (50) | C1 (100) | 350 | 40 | 40 | 150 |
| A2 (100) | B4 (50) | C1 (100) | 350 | 40 | 40 | 200 |

EXAMPLE 4

By way of comparison two lower molecular weight hydrocarbon polymers, B5 and B6, were tested in combination with the flow improver A2.

Hydrocarbon Polymer B5 had a number average molecular weight of approximately 1,500 and contained 89 wt % ethylene and 11 wt % propylene and was prepared by a free radical synthesis.

Hydrocarbon Polymer B6 was a homopolymer of ethylene having a number average molecular weight of about 1,000 (low density polyethylene).

| Filterability Test FSA 2 Cooling Condition X Fuel 1 | | |
|---|---|---|
| Additive (ppm) | | |
| Flow Improver | Hydrocarbon Polymer | Mesh Passed |
| A2 (100) | — | 40 |
| A2 (125) | — | 40 |
| A2 (150) | — | 80 |
| A2 (100) | B2 (50) | 120 |
| A2 (100) | B5 (50) | 40 |
| A2 (100) | B6 (50) | 40 |

EXAMPLE 5

| Filterability Test FSA 2 Cooling Condition X Fuel 3 | | | |
|---|---|---|---|
| Additive (ppm) | | | |
| Flow Improver | Hydrocarbon Polymer | Polar Compound | Mesh Passed |
| A2 (100) | — | — | 40 |
| A2 (200) | — | — | 80 |
| A2 (250) | — | — | 80 |
| A2 (100) | B2 (100) | — | 80 |
| A2 (200) | B2 (50) | — | 120 |
| — | B2 (50) | C1 (150) | 350 |

In this Example fuels containing a flow improver were compared with those containing certain combinations of two of the classes A, B and C.

EXAMPLE 6

Various ethylene-propylene copolymers were added to a base diesel fuel flow improver additive package and were then tested in a middle distillate diesel fuel oil having a cloud point of −12° C. The Base Additive Package (BAP) consisted of 20 wt. % (of a concentrate of about 55 wt. % of heavy aromatic naphtha oil and about 45 wt. % of the previously described distillate flow improver A2), 20 wt. % of foots oil, 10 wt. % of polar compound C4 and 50 wt. % of a heavy aromatic naphtha as a solvent.

These materials are described in detail below.

Polar Compound C4

This was a diamide of one mole of maleic anhydride and two moles of di[hydrogenated tallow] amine.

Foots Oil

The foots oil used herein was obtained as a distillation stream of an oil fraction boiling between 370° C. and 522° C. intermediate of the turbine lubricating oil stream and the residua containing slack wax. The foots oil is a wax solid containing 48.6 wt. % oil, has a specific gravity (°API) of 0.8853, an average molecular weight (GPC) of non-oil portion of 484, 2.35 wt. % content of n-paraffins ranging from 19 to 28, predominantely 22 to 28, carbons and average carbon number of 24.9. The balance of the non-oil portion was believed to be iso- and cycloparaffins of 23 to 39 carbons.

Heavy Aromatic Naphtha (HAN)

This is a solvent for the additive packages and typically has an aniline point of 24.6° C., a specific gravity (°API) of 0.933, a boiling range of 179° C. to 235° C. and is composed of 4 wt % paraffins, 6.7 wt % naphthenes, 87.3 wt % aromatics, e.g. polyalkyl aromatics, and 2.0 wt % olefins.

Hydrocarbon Polymer B7 consisted of a concentrate in diluent oil of about 5 wt % of an ethylene propylene copolymer of about 44 wt % ethylene and about 56 wt % propylene which had a thickening efficiency (T.E.) of 5.

Thickening Efficiency is the ratio of weight percent polyisobutylene (20,000 Staudinger mol. wt) required to thicken a Reference Oil to a viscosity of 12.4 centistokes (cs) at 210° F., to weight percent ethylene-propylene copolymer required to thicken the Reference Oil to the same viscosity.

The reference oil was LP Solvent 150 N—a low pour solvent-refined Midcontient hydrocarbon lube base stock characterised by viscosity of 150–160 SUS at 100° F., a VI of 105, and a pour point of about 0° F.

Based on a T.E. of 5, the number average of the ethylene-propylene copolymer is estimated to be at least 100,000.

Hydrocarbon Polymer B8 was a polymer of about 44 wt % ethylene and about 56 wt % propylene having a thickening efficiency of 1.4, and a number average molecular weight in the range of about 17,000 to about 20,000 and was used as a 13.6 wt % solution in oil.

Hydrocarbon Polymer B9 was a copolymer of about 67 wt % ethylene and about 23 wt % propylene, having a thickening efficiency of about 2.8 and a number average molecular weight of about 55,000 and was used as a 6.9 wt % solution in oil.

Hydrocarbon Polymer B10 was an oil concentrate containing about 3.4 wt %, hydrocarbon polymer B8 and 4.0 wt % of hydrocarbon polymer B10.

Hydrocarbon Polymer B11 was an ethylene-propylene copolymer of about 44 wt % ethylene and about 56 wt % propylene having a thickening efficiency of about 2.8 and a number average molecular weight of about 60,000 to 65,000 and was used as a 8.3 wt % solution in oil.

Hydrocarbon Polymer B12 was a polyisobutylene having a thickening efficiency of 1 and a Staudinger molecular weight of about 18,000 and was used as a 20 wt % solution in oil.

Hydrocarbon Polymer B13 was a polyisobutylene having a Staudinger molecular weight of about 10,500 and a thickening efficiency of 0.6 and was used as a 35 wt % solution in oil.

All the above ethylene propylene copolymers were produced by a Ziegler-Natta synthesis and had a $\overline{M}w/\overline{M}n$ ratio of less than 4. Membrane osmometry was used to determine the molecular weights of these substantially linear polymers.

The middle distillate diesel fuel was treated with either 2,000 ppm (parts per million) by weight, based on the weight of the fuel oil, of 1,200 ppm of the Base Additive Package containing the ethylene-vinyl acetate copolymer, the foots oil and the diamide, and then by adding varying amounts of the above described Hydrocarbon Polymers B6-B12. The resulting compositions were tested in a Low Temperatures Flow Test (LTFT) which was carried out as follows:

200 cc of the treated oil composition was cooled from ambient temperatures to about 30° F., then at the rate of 2° F. per hour down to 0° F. and then filtered through a 17 micron mesh screen under 6 inches of mercury vacuum. The number of seconds required to pass the sample through the screen is measured as well as the milliliters of the filtered sample that is collected. If the sample passed through in 60 seconds or less, it is considered a pass (P), while if more than 60 seconds is required, the test is rated a failure (F).

The compositions tested and the test results are summarized in the following Table.

TABLE

| | | LTFT at 0° F. | | | |
|---|---|---|---|---|---|
| Run | PPM Additive | Time (sec) | P/F | Mls Recorded | % Improvement in BAP |
| 1 | 2000 BAP | 36.7 | P | 195 | — |
| 2 | 2000 BAP + 400 B7 | 33.7 | P | 195 | 8% |
| 3. | 2000 BAP + 400 B8 | 32.7 | P | 195 | 12% |
| 4. | 1200 BAP | 47.0 | P | 195 | — |
| 5. | 1200 BAP + 400 B7 | 30.1 | P | 195 | 56% |
| 6. | 1200 BAP + 400 B8 | 29.8 | P | 195 | 51% |
| 7. | 2000 BAP + 400 B9 | 60.0<br>184.0 | F<br>F | 135<br>195 | −68% |
| 8 | 1201 BAP + 400 B10 | 56.9 | P | 195 | −18% |
| 9 | 1200 BAP + 400 B11 | 35.8 | P | 195 | 31% |
| 10 | 1200 BAP + 400 B12 | 35.6 | P | 200 | 32% |
| 11 | 1200 BAP + 400 B13 | 36.8 | P | 200 | 27% |
| 12 | 1200 BAP + 25 B11 | 60.0<br>100.0 | F<br>F | 145<br>195 | −56% |
| 13 | 1200 BAP + 25 B13 | 60.0<br>66.9 | F<br>F | 170<br>195 | −30% |
| 14 | 800 A2 400 C4 400 B7 | 46.5 | P | 190 | — |
| 15 | 500 A2 250 C4 400 B7 | 39.2 | P | 195 | — |
| 16 | 400 C4 400 B7 | 41.2 | P | 195 | — |
| 17 | 500 A2 400 B7 | 60.0 | F | 0 | — |
| 18 | 800 Petrolatum 400 B7 | 60.0 | F | 0 | — |

As seen by the preceding Table, Runs 2 and 3 show that the ethylene copolymers used reduced the time of passage through the screen and the percent improvement is reported as 8% and 12% over the Base Additive Package (BAP). Run 4 reduced the amount of the Base Additive Package to 1200 ppm. The low ethylene content copolymers B7 and B8 of Runs 5 and 6 gave significant improvements in increasing the rate of passage of the treated fuel through the fine screen. Run 7 shows that using a high ethylene content polymer B9 actually had a negative effect in two LTFT tests and extended the time for passage of the fuel through the screen. Similar results are shown by Run 8. Run 9 shows another example of using the low ethylene copolymer for increasing the rate of flow through the screen. Runs 10 and 11 demonstrate the effectiveness of a polyisobutylene polymer. In the case of Runs 12 and 13, the amounts of the polymer concentrate is reduced to 25 ppm which on an active ingredient basis meant that only about 3 ppm of ingredient was actually being added. Here, the small amount of polymer that was added increased the flow time through the filter and failed the test showing that at least in the test composition there was a threshold amount of polymer required to obtain good results.

Run 14 was treated with 800 ppm of the aforesaid oil concentrate of additive A2, 400 ppm of C4 and 400 ppm of the oil concentrate of Hydrocarbon Polymer B7. Run 15 was prepared from the same ingredients in different proportions, Run 16 used only the diamide and the hydrocarbon polymer, Run 17 used the flow improver concentrate of A2 and the hydrocarbon polymer B7 and Run 18 used 800 parts of a petrolatum which was Foots Oil.

All of the Hydrocarbon Polymers B7 to B11 in the preceeding Table were used in the form of the concentrates, for example Run 2 used 400 ppm of B7 or 20 ppm of actual copolymer.

In general, hydrocarbon polymers having number average molecular weights of $10^4$ to 250,000 which are useful as lubricating oil viscosity index improvers such as B1 to B4 and B7 to B13 are useful as B components, and are particularly preferred.

What we claim is:

1. A wax-containing petroleum fuel oil comprising a major proportion of a distillate oil boiling in the range of 120° to 500° C., which fuel oil has been improved in its low temperature flow properties, containing in the range of about 0.001 to 0.5 wt.%, based on the weight of the total composition, of a flow improving combination of:

(A) one part by weight of an oil-soluble ethylene backbone distillate flow improving polymer having a number average molecular weight in the range of about 500 to 50,000 which is a copolymer consisting essentially of 3 to 40 molar proportions of ethylene per molar proportion of unsaturated ester of the general formula:

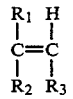

wherein $R_1$ is methyl or hydrogen, $R_2$ is —$OOCR_4$ or —$COOR_4$ where $R_4$ is a $C_1$ to $C_{28}$ alkyl group and $R_3$ is hydrogen or —$COOR_4$;

(B) 0.1 to 10 parts by weight of an oil soluble hydrocarbon polymer having a number average molecular weight in the range of $10^3$ to $10^6$ selected from the group consisting of: copolymers comprising about 15 to 90 wt.% ethylene and 10 to 85 wt.% $C_3$ to $C_{30}$ olefin; hydrogenated polymer consisting essentially of styrene or alkylated styrene with conjugated diene selected from the group consisting of butadiene, isoprene, piperylene and 2,3-dimethyl butadiene, or mixtures thereof; polymers consisting essentially of polyisobutylene; hydrogenated conjugated diene polymers consisting essentially of 1,3-butadiene, isoprene, 1,3-pentadiene, or 1,3-dimethyl butadiene, or mixtures thereof; and (C) 0.1 to 10 parts by weight of polar oil soluble compound selected from the group consisting of:

(1) oil soluble nitrogen compounds containing a total of 30 to 300 carbon atoms and having at least one straight chain alkyl segment of 8 to 40 carbons and selected from the class consisting of amine salts and/or amides of hydrocarbyl carboxylic acids or anhydrides having 1 to 4 carbonyl groups; and (2) compounds, other than (1) above, of the formula RX wherein R is an oil solubilizing hydrocarbon group of 8 to 150 carbon atoms and X is selected from the group consisting of carboxylate, sulfonate, sulphate, phosphate, phenate, and borate groups.

2. A fuel oil according to claim 1, wherein said ethylene backbone distillate flow improver has a molecular weight of about 1000 to 6000 and is a copolymer of 4 to 20 molar proportions of ethylene with said unsaturated ester, and wherein $R_4$ is a $C_1$ to $C_8$ alkyl group.

3. A fuel oil according to claim 2, wherein said ethylene backbone polymer is a copolymer of ethylene and vinyl acetate.

4. A fuel oil according to claim 1 or 3, wherein said hydrocarbon polymer is a lubricating oil viscosity index improving copolymer comprising ethylene and propylene and having a number average molecular weight in the range of about $10^4$ to $10^6$.

5. A fuel oil according to claim 1 or 3, wherein said hydrocarbon polymer is a polyisobutylene lubricating oil viscosity index improver.

6. A fuel oil according to claim 1 or 3, wherein said polar oil soluble compound is said oil soluble nitrogen compound which is a salt and/or amide of an acid material selected from the group consisting of maleic anhydride, alkenyl succinic anhydride, phthalic anhydride, and citric acid, with amine having $C_{14}$ to $C_{24}$ straight chain groups.

7. A fuel oil according to claim 6, wherein said nitrogen compound is phthalic acid or phthalic anhydride reacted with secondary alkyl monoamine having straight chain alkyl groups of about 14 to 18 carbon atoms.

8. A fuel oil according to claim 6, wherein said nitrogen compound is citric acid reacted with secondary alkyl amine having alkyl groups essentially of 14 to 18 carbon atoms.

9. A distillate fuel oil according to claim 6, wherein said nitrogen compound is the reaction product of maleic anhydride and secondary alkyl amine having alkyl groups essentially of 14 to 18 carbon atoms.

10. A distillate fuel oil containing about 0.001 to 0.5 wt.% of an additive combination of one part by weight of a copolymer of 4 to 20 moles of ethylene per mole of vinyl acetate, said copolymer having a number average molecular weight of about 1000 to 6000; about 0.1 to 10 parts by weight of a viscosity index improving lubricating oil additive which is a hydrocarbon polymer having a number average molecular weight in the range of about 20,000 to 250,000 selected from the group consisting of polymers consisting essentially of polyisobutylene and copolymers comprising 30 to 80 wt.% ethylene and 10 to 85 wt.% propylene; and about 0.1 to 10 parts by weight of a nitrogen compound which is the reaction product of an acid selected from the group consisting of maleic, succinic, phthalic and citric acid, or anhydride thereof, with primary or secondary amine having straight chain $C_{12}$ to $C_{30}$ alkyl groups.

11. A distillate fuel oil according to claim 10, useful as a diesel engine fuel oil and which further contains foots oil.

12. A fuel oil according to claim 10, which contains about 0.005 to 0.2 wt.% of said additive combination including about 0.2 to 2 parts by weight of copolymer consisting essentially of ethylene and propylene, and about 0.2 to 1 part by weight of the reaction product of phthalic anhydride and hydrogenated secondary tallow amine.

* * * * *